US010647394B2

(12) United States Patent
Toth et al.

(10) Patent No.: US 10,647,394 B2
(45) Date of Patent: May 12, 2020

(54) HEAT EXCHANGE DEVICE FOR USE WITH UNDERWATER PRESSURIZED GAS SOURCE

(71) Applicant: Huish Outdoors, LLC, Salt Lake City, UT (US)

(72) Inventors: Douglas J. Toth, San Clemente, CA (US); Daniel Thomas, Las Vegas, NV (US)

(73) Assignee: Huish Outdoors, LLC, Salt Lake City, UT (US)

( * ) Notice: Subject to any disclaimer, the term of this patent is extended or adjusted under 35 U.S.C. 154(b) by 324 days.

(21) Appl. No.: 15/394,867

(22) Filed: Dec. 30, 2016

(65) Prior Publication Data

US 2018/0186437 A1 Jul. 5, 2018

(51) Int. Cl.

| | |
|---|---|
| ***B63C 11/28*** | (2006.01) |
| ***F28D 1/02*** | (2006.01) |
| ***F28D 1/047*** | (2006.01) |
| ***B63C 11/22*** | (2006.01) |

(52) U.S. Cl.
CPC ..... *B63C 11/28* (2013.01); *B63C 11/2209* (2013.01); *B63C 11/2227* (2013.01); *F28D 1/022* (2013.01); *F28D 1/0472* (2013.01)

(58) Field of Classification Search
CPC . B63C 11/28; B63C 11/2209; B63C 11/2227; F28D 1/022; F28D 1/0472
See application file for complete search history.

(56) References Cited

U.S. PATENT DOCUMENTS 5,689,968 A 11/1997 Frustaci
2002/0179089 A1 12/2002 Morgan et al.

FOREIGN PATENT DOCUMENTS

FR 2257487 8/1975

OTHER PUBLICATIONS

Mike Ward, Scuba Regulator Freezing Chilling Facts & Risks Associated with Cold Water Diving, Article, Published Apr. 2, 2014 (Shown in Attachment 1).
Written Opinion of the International Searching Authority, International Patent PCT App. No. PCT/US2017/068192, dated Mar. 19, 2018 (Shown in Attachment 2).
International Search Report, International Patent PCT App. No. PCT/US2017/068192, dated Mar. 19, 2018 (Shown in Attachment 3).
Notification Concerning Transmittal of International Preliminary Report of Patentability, International Patent PCT App. No. PCT/US2017/068192, dated Jul. 11, 2019 (Shown in Attachment 4).
(Continued)

*Primary Examiner* — Nathan R Price
*Assistant Examiner* — Justin L Zamory
(74) *Attorney, Agent, or Firm* — Austin Rapp

(57) ABSTRACT

A device for heat exchange for use with underwater diving equipment including a pressurized gas source is disclosed. The heat exchange device includes a manifold and a heat sink. The manifold distributes gas supplied from the pressurized gas source to breathing equipment. The heat sink is for warming up the gas before the gas is distributed to the breathing equipment using heat exchange with ambient water surrounding the heat sink. The manifold and the heat sink are connected such that the gas warmed up by the heat sink returns to the manifold before being distributed to the breathing equipment. The returning warm gas may warm up the manifold and the cold gas entering the manifold.

12 Claims, 8 Drawing Sheets

(56) References Cited

OTHER PUBLICATIONS

International Preliminary Report on Patentability (which includes the previously submitted Written Opinion of the International Searching Authority), International Patent PCT App. No. PCT/US2017/068192, dated Jul. 2, 2019 dated Jul. 11, 2019 (Shown in Attachment 5).

HEAT EXCHANGE DEVICE FOR USE WITH UNDERWATER PRESSURIZED GAS SOURCE

TECHNICAL FIELD

This application is related to a device for heat exchange for use with underwater diving equipment including a pressurized gas source. More particularly, this application is related to a device attached to scuba diving equipment for warming up compressed breathing gas from a pressurized gas source.

BACKGROUND

Scuba divers carry one or more tanks of compressed air or mixed gas for diving. In order to enable the divers to breathe normally underwater, the gas pressure should be reduced to an ambient pressure. Regulators are used to reduce the gas pressure to an ambient pressure, typically in two stages. The first stage regulator typically reduces the gas pressure from about 2,500 to 3,500 psi to about 150 psi. The second stage regulator further reduces the gas pressure to an ambient pressure.

For each breathing cycle, the high-pressure gas flows through the first stage regulator valve orifice. As the compressed gas flows through the valve of the first stage regulator it rapidly expands and flows through a low-pressure hose to the second stage regulator. This rapid drop of the pressure and expansion of the gas at the first stage regulator causes a substantial decrease of the temperature of the gas. As the gas travels through the second stage regulator, the gas pressure is reduced again when it changes from about 150 psi to ambient pressure, which causes additional cooling in the second stage.

Since the housing and the valve of the second stage regulator may be cooled to below freezing temperatures, ice may build up on the surfaces of the cooled parts, which may prevent proper operation of the device. This can result in reduced performance or complete failure of the second stage. In addition, breathing the cold air (at a much lower temperature than ambient) increases respiratory heat loss and thermal stress to the diver. For these reasons, it is highly advantageous to warm up the gas flowing into the second stage regulator to prevent icing and failure of the second stage.

A heat exchange device has been used to warm up the pressurized gas exiting the first stage regulator. For example, U.S. Patent Application Publication No. 2002/0179089 to Morgan et al. discloses a heat exchange device for use with the underwater pressurized gas source. FIG. 1 of the present application shows the heat exchange device disclosed in the Morgan application. The heat exchange device in the Morgan application includes a length of tubing 8. The gas exiting the first stage regulator 14 flows through the tubing 8 toward the manifold block 18 while being warmed up by the ambient water surrounding the tubing 8. The gas then flows through outlet tubes 22 via outlet ports 20 of the manifold block 18 to the second stage regulator. The tubing 8 is made of heat conducting material for facilitating heat exchange.

In the heat exchange device that is disclosed in the Morgan application, one end of the tubing 8 is connected to the first stage regulator 14 through an inlet tube 16. The other end of the tubing 8 is connected to the manifold block 18. Breathing gas exiting the first stage regulator 14 enters the tubing 8 through an inlet port 17, and the breathing gas exits the tubing 8 through an outlet port 19. The inlet port 17 and the outlet port 19 are in different locations, spaced apart from one another.

In Morgan's heat exchange device, the air entering the tubing 8 is extremely cold, so that it is subject to freezing at the inlet port 17. Consequently, ice may start to build up around the inlet port 17 and the portion of the tubing 8 that is close to the inlet port 17. This significantly reduces the efficiency of the heat exchange device.

Therefore, there is a need for a more efficient heat exchange device for warming up compressed air from a pressurized air source that is being used in connection with underwater diving equipment.

SUMMARY

In accordance with one embodiment, a heat exchange device for use with underwater diving equipment including a pressurized gas source is disclosed. The heat exchange device includes a manifold and a heat sink. The manifold includes a first chamber and a second chamber separated by a wall. Each chamber includes an inlet and an outlet for flow of gas into and out of each chamber. The heat sink is for heat exchange between the gas flowing in the heat sink and ambient water surrounding the heat sink. The heat sink may include a passage for the gas to flow. A first end of the passage may be connected to the outlet of the first chamber, and a second end of the passage may be connected to the inlet of the second chamber.

The heat sink may include a coiled tubing. The tubing may comprise an internal diameter that is between 5 mm and 10 mm. As used herein, the term "internal diameter" refers to the diameter of the inside of the tubing, not including the thickness of the tubing wall. The tubing may comprise an uncoiled length that is between 36 inches and 120 inches.

The inlet of the first chamber may be configured to be connected to a first stage regulator and the outlet of the second chamber may be configured to be connected to a second stage regulator.

At least one of the manifold and the heat sink may be made of copper, copper alloy, or other material having high thermal conductivity properties. In accordance with the present disclosure, a material may be considered to have "high thermal conductivity properties" if its thermal conductivity is at least 29 W/m*K.

The wall may be sufficiently thin so that the first chamber of the manifold is warmed up by the gas in the second chamber of the manifold that has passed through the heat sink.

The second chamber of the manifold may include a plurality of outlets that are each configured to be connected to a second stage regulator.

In accordance with another embodiment, a heat exchange device for use with underwater diving equipment including a pressurized gas source is disclosed. The heat exchange device may include a manifold and a heat sink. The manifold may be for distributing gas supplied from a pressurized gas source to breathing equipment. The heat sink may be for warming up the gas before the gas is distributed to the breathing equipment. The warming may occur via heat exchange with ambient water surrounding the heat sink. The manifold and the heat sink may be connected such that the gas warmed up by the heat sink flows through the manifold to the breathing equipment.

The heat sink may include a coiled tubing. The tubing may comprise an internal diameter that is between 5 mm and 10 mm. The tubing may comprise an uncoiled length that is between 36 inches and 120 inches.

The manifold may include a first chamber and a second chamber that are separated by a wall. A first end of the coiled tubing may be connected to an outlet of the first chamber. A second end of the coiled tubing may be connected to an inlet of the second chamber.

An inlet of the first chamber may be configured to be connected to a first stage regulator. An outlet of the second chamber may be configured to be connected to a second stage regulator.

At least one of the manifold and the heat sink may be made of copper, copper alloy, or other material having high thermal conductivity properties.

The manifold may include a first chamber and a second chamber. The first chamber may include an inlet that is configured to be connected to a first stage regulator. The second chamber may include a plurality of outlets that are each configured to be connected to a second stage regulator.

DETAILED DESCRIPTION

The embodiments of the present disclosure will be explained with reference to the drawings, wherein like parts are designated by like numerals throughout. It will be readily understood that the components of the present disclosure, as generally described and illustrated in the figures herein, could be arranged and designed in a wide variety of different configurations. Thus, the following more detailed description of the exemplary embodiments, as represented in the figures, is not intended to limit the scope of the invention, as claimed, but is merely representative of exemplary embodiments of the disclosure.

Figure 1:
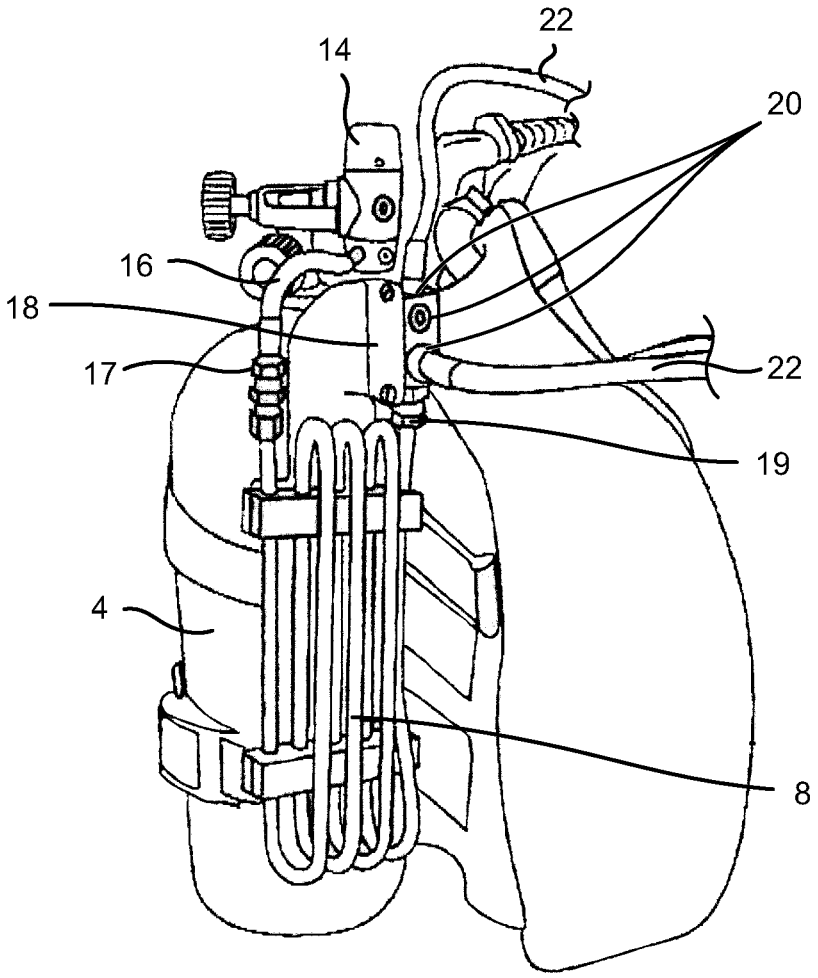
FIG. 1 (Prior Art)
FIG. 1 is a prior art heat exchange device for use with underwater pressurized gas.
Figure 2:
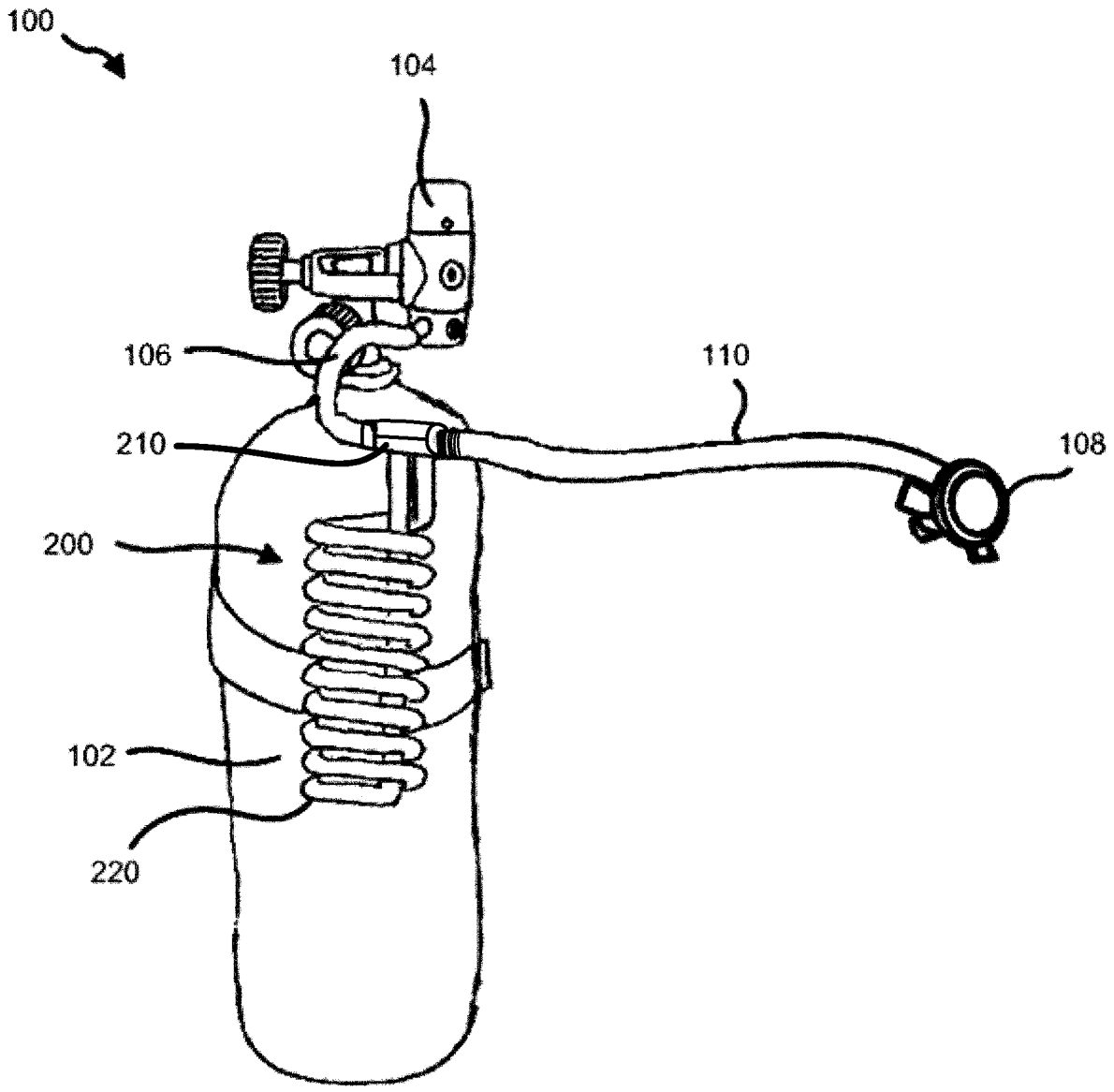
FIG. 2 shows diving equipment including an example of a heat exchange device in accordance with one embodiment of the present application.

FIG. 2 shows diving equipment 100 including an example of a heat exchange device 200 in accordance with one embodiment of the present application. A diver carries a tank 102 containing pressurized breathing gas. The pressure of the gas may be reduced in multiple steps with regulators. A first stage regulator 104 for reducing the high pressure of the gas from the tank 102 is typically installed at the top of the tank 102. The first stage regulator 104 may be connected via an inlet tube 106 to the heat exchange device 200, which is connected to the second stage regulator 108 through a low-pressure hose 110. The heat exchange device 200 may include a manifold 210 and a heat sink 220. These components will be described in greater detail below.

The gas provided from the tank 102 flows through the heat exchange device 200 toward the second stage regulator 108. The heat exchange device 200 is configured to substantially increase the temperature of the gas flowing therein. The gas is warmed up by the ambient water while flowing through the heat exchange device 200.

Figure 3:
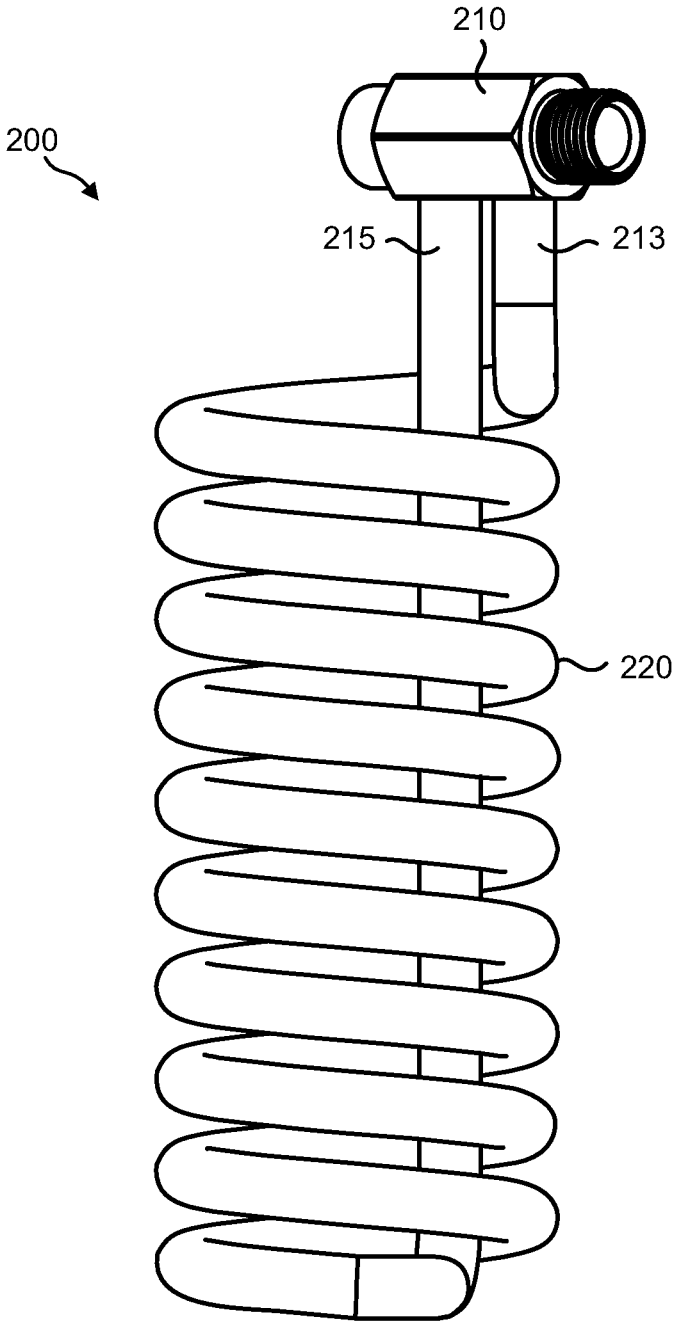
FIG. 3 is a perspective view of an example of a heat exchange device in accordance with one embodiment of the present application.

FIG. 3 is a perspective view of an example heat exchange device 200 in accordance with one embodiment. The heat exchange device 200 may include a manifold 210 and a heat sink 220.

The manifold 210 is a component for distributing gas supplied from the pressurized gas source to breathing equipment, e.g., the second stage regulator 108. The heat sink 220 is a component for warming up the gas before the gas is distributed to the breathing equipment using heat exchange with ambient water surrounding the heat sink 220. The heat sink 220 includes a passage for the gas to flow such that the gas gets warmed up as it flows through the passage. For example, the heat sink 220 may be a helical coiled tubing as shown in FIG. 3. The manifold 210 and the heat sink 220 are connected such that the cold gas enters the heat sink 220 via the manifold 210 and the gas warmed up by the heat sink 220 returns to the manifold 210 before being distributed to the breathing equipment.

Figure 4:
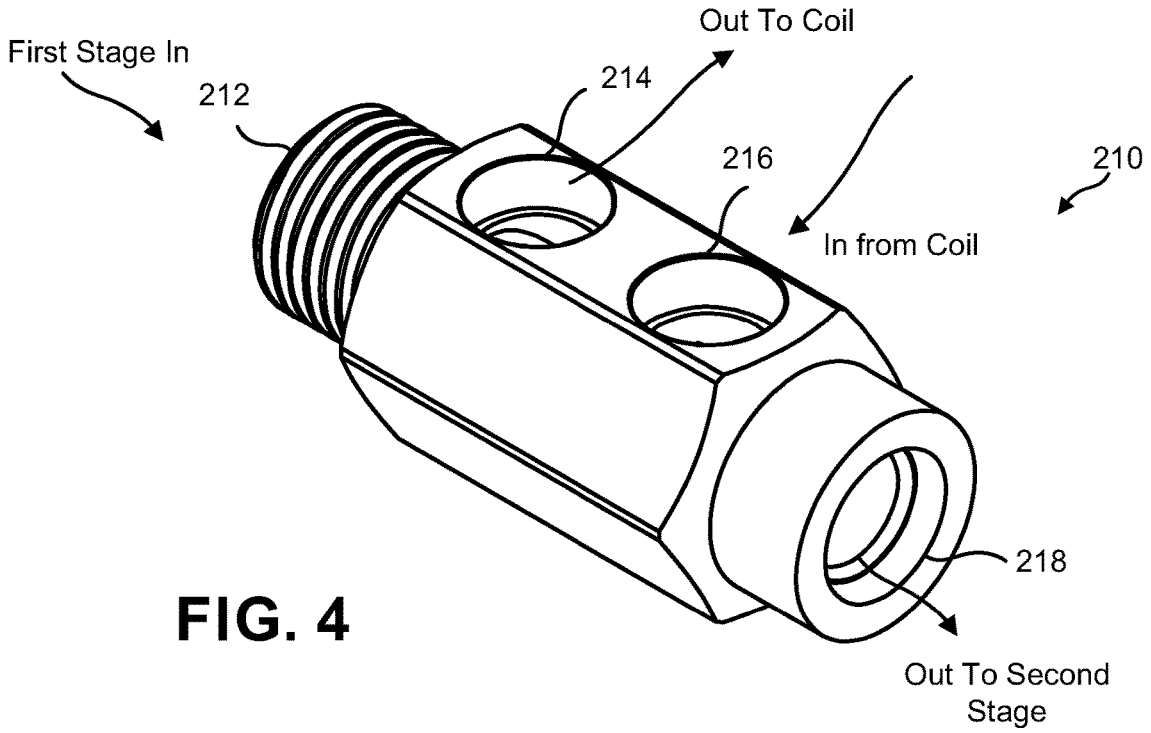
FIG. 4 is a perspective view of an example of a manifold in accordance with one embodiment of the present application.

FIG. 4 shows an example of a manifold 210 in accordance with one embodiment. The manifold 210 may be a tube-like component including multiple inlets 212, 216 and multiple outlets 214, 218. The gas supplied from the first stage regulator 104 enters the manifold 210 through an inlet 212 and exits through an outlet 214. A first end 213 (illustrated in FIG. 3) of the heat sink 220 may be connected to the outlet 214 of the manifold 210. The gas enters the heat sink 220 through the outlet 214 and heat exchange occurs between the gas and ambient water surrounding the heat sink 220 while the gas flows through the heat sink 220. A second end 215 (illustrated in FIG. 3) of the heat sink 220 may be connected to the inlet 216 of the manifold 210. After passing through the heat sink 220 and being warmed up by the ambient water surrounding the heat sink 220, the gas re-enters the manifold 210 through the inlet 216. The gas then exits the manifold 210 through the outlet 218 toward the second stage regulator 108. The manifold 210 may include additional outlet(s) for additional equipment.

Figure 5:
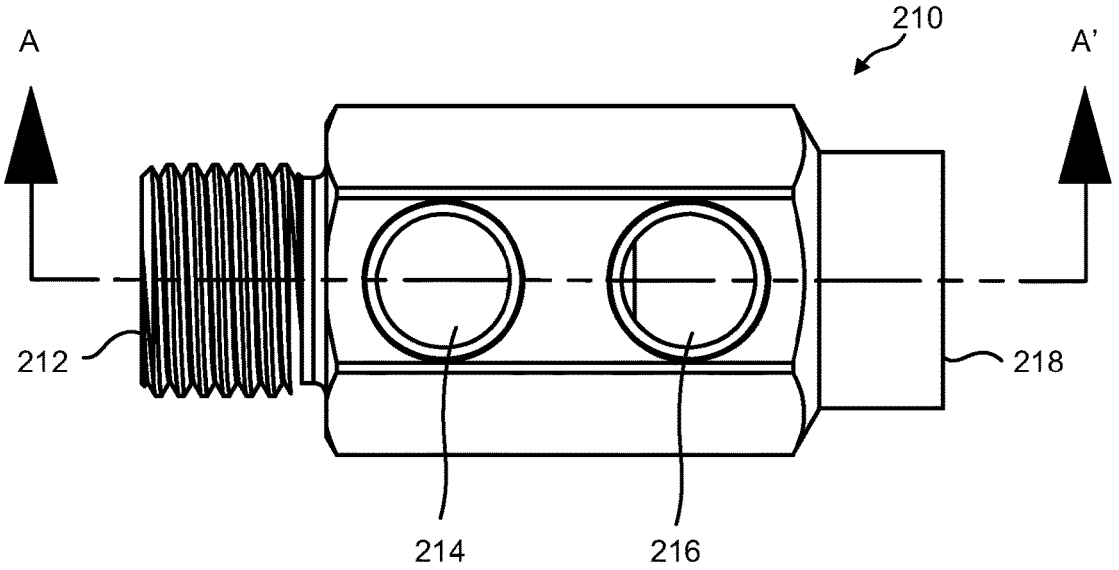
FIG. 5 is a plan view of the manifold of FIG. 4.
Figure 6:
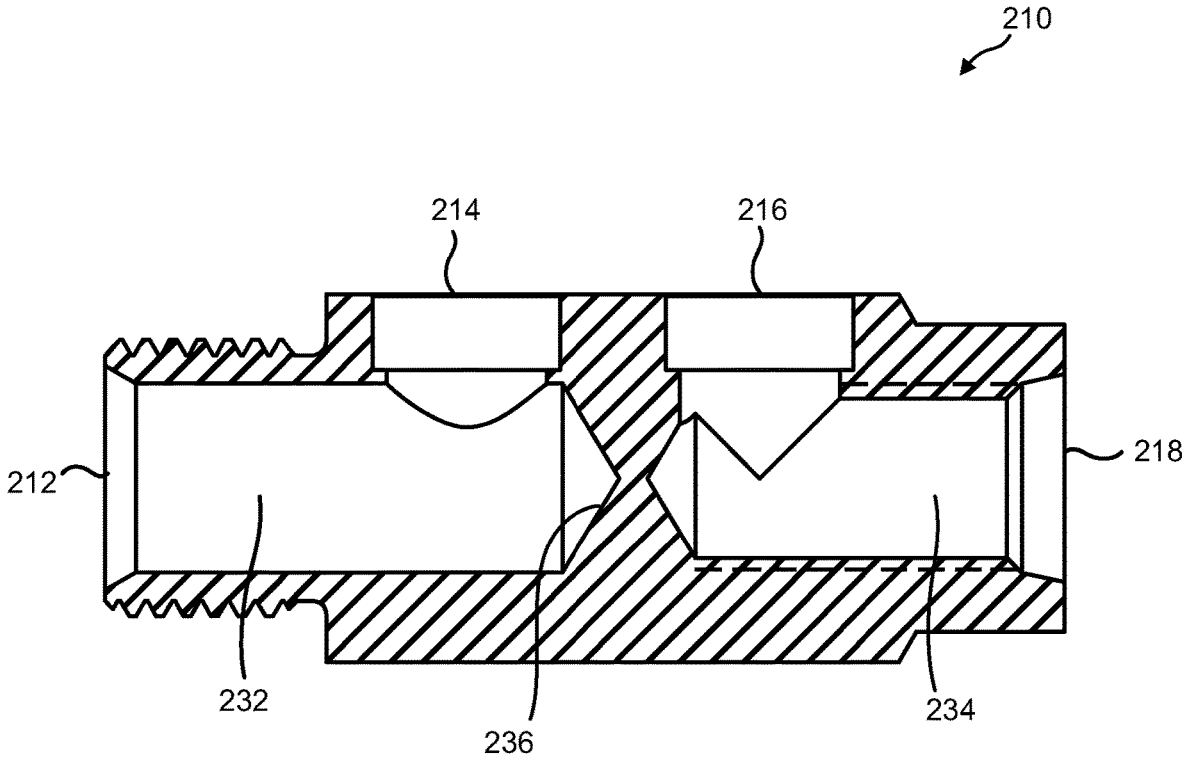
FIG. 6 is a section view of the manifold of FIG. 4 in section A-A'.

FIG. 5 is a top view of the manifold 210 of FIG. 4, and FIG. 6 is a section view of the manifold 210 in section A-A'. As shown in FIG. 6, the example manifold 210 includes two chambers 232, 234 inside separated by a wall 236. The first chamber 232 includes the inlet 212 and the outlet 214, and the second chamber 234 includes the inlet 216 and the outlet 218.

Figure 7:
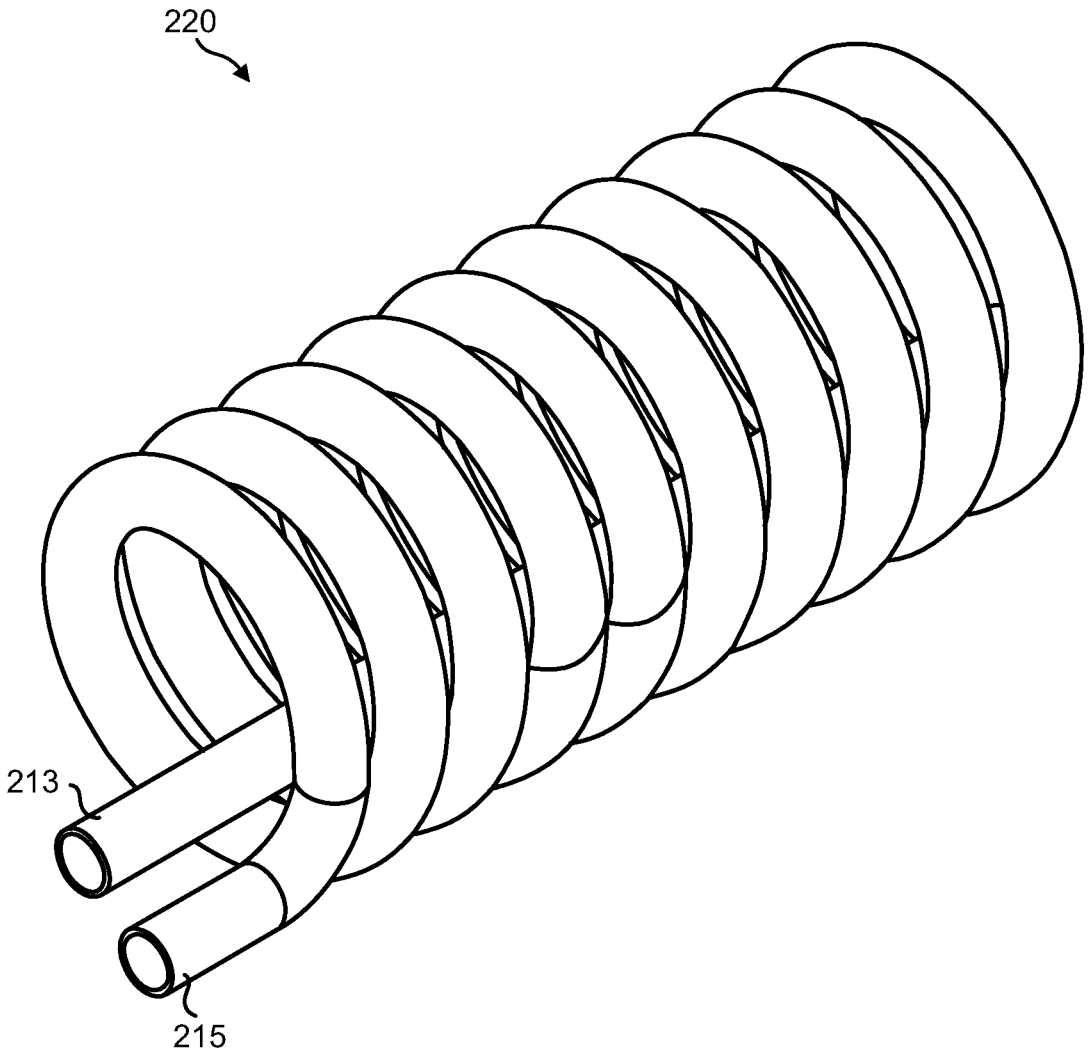
FIG. 7 is a perspective view of an example of a heat sink coil in accordance with one embodiment of the present application.

Referring collectively to FIGS. 2, 3, and 7, the first end 213 of the heat sink 220 (e.g., coiled tubing) may be connected to the outlet 214 of the first chamber 232. The second end 215 of the heat sink 220 may be connected to the inlet 216 of the second chamber 234. The inlet 212 of the first chamber 232 may be connected to the first stage regulator 104 via the inlet tube 106. The outlet 218 of the second chamber 234 may be connected to the second stage regulator 108 via the low-pressure hose 110. The gas supplied from the first stage regulator 104 goes into the heat sink 220 through the first chamber 232 of the manifold 210 and returns to the second chamber 234 of the manifold 210 after being warmed up by the heat sink 220.

The warm gas returning from the heat sink 220 to the second chamber 234 of the manifold 210 may warm up the entire manifold 210 and the cold gas entering the first chamber 232. As disclosed above, as the compressed gas from the tank 102 flows through the first stage regulator 104, the gas rapidly expands and the pressure of the gas substantially decreases. This rapid expansion and drop of pressure cause a substantial decrease of the temperature of the gas.

In accordance with the embodiments disclosed herein, since the gas returned to the manifold 210 from the heat sink 220 is warmed up by the ambient water, the returning warm gas may warm up the manifold 210 and the cold gas entering the manifold 210. This can prevent the problem that was described above in connection with the Morgan application, namely, the buildup of ice near the inlet port 17, which reduces the efficiency of the heat exchange device.

More specifically, in the Morgan application, the cold breathing gas exiting the first stage regulator 14 enters the tubing 8 through an inlet port 17, and the warmed-up breathing gas exits the tubing 8 through an outlet port 19. The inlet port 17 and the outlet port 19 are in different locations, spaced apart from one another. Because the breathing gas entering the tubing 8 is extremely cold, ice may start to build up around the inlet port 17 and the portion of the tubing 8 that is close to the inlet port 17.

In contrast, in accordance with the present disclosure, the point where the cold breathing gas enters the heat sink 220 (i.e., via the inlet 212 and the outlet 214 of the manifold 210) and the point where the warmed-up breathing gas exits the heat sink 220 (i.e., via the inlet 216 and the outlet 218 of the manifold 210) are located relatively close to one another, within the same manifold 210. The warmed-up breathing gas may warm up the area where the cold breathing gas enters the heat sink 220, thereby reducing the likelihood that ice will build up in this area. This significantly improves the efficiency of the heat exchange device relative to the design shown in the Morgan application.

The heat exchange device 200 may include one or more features that facilitate heat transfer from the second chamber 234 (which contains the breathing gas that has been warmed up by traveling through the heat sink 220) to the first chamber 232 (which contains the cold breathing gas supplied from the first stage regulator 104). For example, as noted previously, the manifold 210 may be made of a material having high thermal conductivity properties (e.g., copper, copper alloy). Also, as shown in FIG. 6, the wall 236 separating the two chambers 232, 234 may be relatively thin.

However, neither of these features should be construed as essential. For example, it is not necessary for the wall 236 separating the chambers 232, 234 to be thin. If the manifold 210 is made of a material having sufficiently high thermal conductivity, then sufficient heat transfer may occur from one chamber 234 to the other chamber 232, even if the wall 236 is relatively thick.

Similarly, it is not necessary for the manifold 210 to be made of a material having high thermal conductivity properties. For example, in an alternative embodiment, the manifold 210 may be made of a material such as stainless steel.

In other words, in accordance with the present disclosure, the chambers 232, 234 may be positioned so that the warmed-up breathing gas in the second chamber 234 may warm up the cold breathing gas entering the first chamber 232. In order to facilitate this warming, the manifold 210 may be made of a material having sufficiently high thermal conductivity (e.g., copper, copper alloy). Alternatively, or additionally, the wall 236 separating the chambers 232, 234 may be relatively thin.

FIG. 7 is a perspective view of an example of a heat sink 220 in accordance with one embodiment of the present application. In the embodiment depicted in FIG. 7, a single helical coiled tubing is used as a heat sink 220. The internal diameter of the tubing may be between 5 mm and 10 mm. If the internal diameter of the tubing is smaller than 5 mm, then the air flow may be too severely restricted. On the other hand, if the internal diameter of the tubing is greater than 10 mm, then the amount of thermal transfer may be less than desired. The uncoiled length of the tubing may be between 36 inches and 120 inches. Of course, these dimensions are provided for purposes of example only, and should not be interpreted as limiting the scope of the present disclosure.

The configuration of the heat sink 220 that is shown in FIGS. 2, 3, and 7 is for purposes of example only. An element having a different configuration or shape may be used as the heat sink 220 instead of the coiled tubing.

The heat sink 220 may be attached to the tank 102 and used without any protective cover for covering the surroundings of the heat sink 220. Without the protective cover, the heat exchange may be more efficient. Alternatively, a protective cover for covering the surroundings of the heat sink 220 (for example, a mesh cage), may be installed around the heat sink 220.

Figure 8:
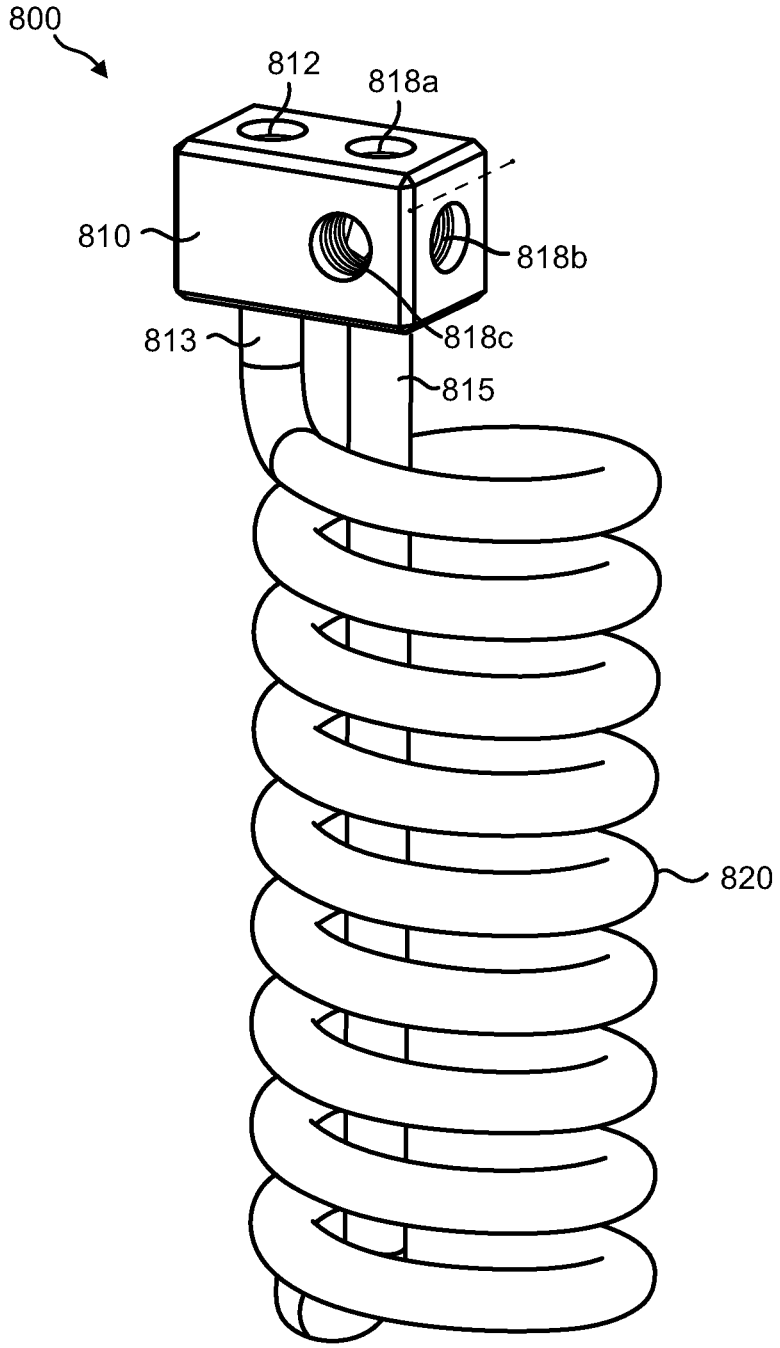
FIG. 8 is a perspective view of a heat exchange device in accordance with another embodiment of the present disclosure.
Figure 9:
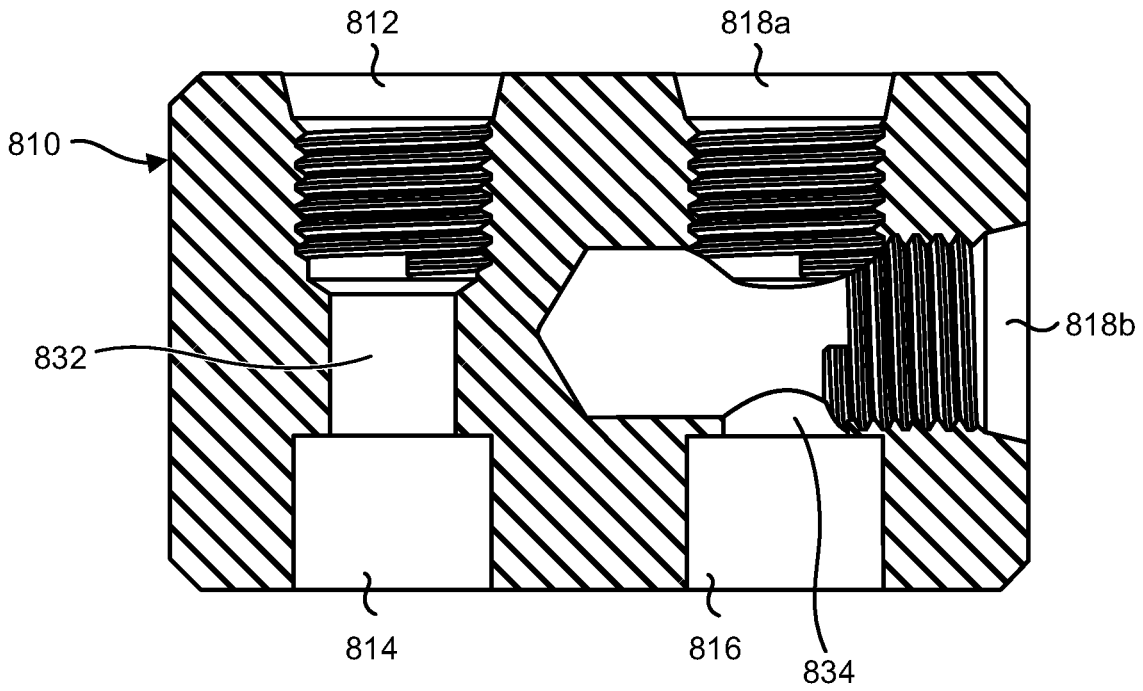
FIG. 9 is a section view of the manifold in the heat exchange device shown in FIG. 8.
Figure 10:
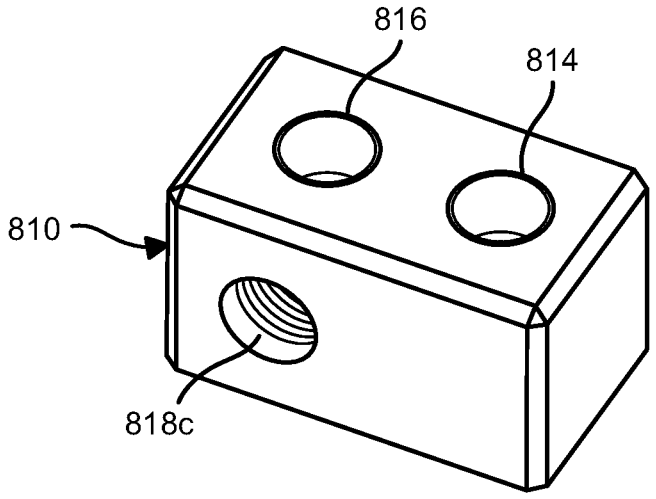
FIG. 10 is a perspective view of the bottom side of the manifold in the heat exchange device shown in FIG. 8.

FIGS. 8-10 illustrate a heat exchange device 800 in accordance with another embodiment of the present disclosure. FIG. 8 is a perspective view of the heat exchange device 800, which includes a manifold 810 and a heat sink 820. FIG. 9 is a section view of the manifold 810 of FIG. 8. FIG. 10 is a perspective view of the bottom side of the manifold 810.

Like the manifold 210 discussed previously, the manifold 810 depicted in FIGS. 8-10 includes an inlet 812 that may be connected to the first stage regulator 104. However, whereas the second chamber 234 of the manifold 210 discussed previously only includes a single outlet 218, the second chamber 834 of the manifold 810 shown in FIGS. 8-10 includes multiple outlets 818*a*-818*c*, each of which may be connected to a different second stage regulator 108 or other pneumatic device such as used to inflate a diver's flotation device or drysuit. Thus, the manifold 810 makes it possible for a single tank 102 of pressurized breathing gas to be used for multiple second stage regulators 108 or pneumatic devices.

As shown in FIG. 9, the manifold 810 includes a first chamber 832 and a second chamber 834. The breathing gas supplied from the first stage regulator 104 may enter the first chamber 832 of the manifold 810 through the inlet 812. A first end 813 of the heat sink 820 (e.g., coiled tubing) may be connected to the outlet 814 of the first chamber 832 of the manifold 810. The gas enters the heat sink 820 through the outlet 814 and heat exchange occurs between the gas and ambient water surrounding the heat sink 820 while the gas flows through the heat sink 820. A second end 815 of the heat sink 820 may be connected to the inlet 816 of the second chamber 834 of the manifold 810. After passing through the heat sink 820 and being warmed up by the ambient water surrounding the heat sink 820, the gas re-enters the manifold 810 through the inlet 816. The gas then exits the manifold 810 through the outlets 818*a*-*c* toward the second stage regulators 108.

The present disclosure may be embodied in other specific forms without departing from its structures, methods, or other characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A heat exchange device for use with underwater diving equipment including a pressurized gas source, comprising:

a manifold including a first chamber and a second chamber separated by a wall, the wall comprising a narrowing portion, each chamber including an inlet and an outlet for flow of gas into and out of each chamber; and a heat sink for heat exchange between the gas flowing in the heat sink and ambient water surrounding the heat sink, wherein the heat sink includes a passage for the gas to flow, wherein a first end of the passage is connected to the outlet of the first chamber, and wherein a second end of the passage is connected to the inlet of the second chamber.

2. A heat exchange device for use with underwater diving equipment including a pressurized gas source, comprising:

a manifold including a first chamber and a second chamber separated by a wall, each chamber including an inlet and an outlet for flow of gas into and out of each chamber; and a heat sink for heat exchange between the gas flowing in the heat sink and ambient water surrounding the heat sink, wherein the heat sink includes a passage for the gas to flow, wherein a first end of the passage is connected to the outlet of the first chamber, and wherein a second end of the passage is connected to the inlet of the second chamber, wherein the wall is sufficiently thin such that during operation of the heat exchange device, the first chamber of the manifold is warmed by the gas in the second chamber of the manifold that has passed through the heat sink.

3. The heat exchange device of claim 2, wherein the heat sink comprises coiled tubing.

4. The heat exchange device of claim 3, wherein:

the tubing comprises an internal diameter that is between 5 mm and 10 mm; and the tubing comprises an uncoiled length that is between 36 inches and 120 inches.

5. The heat exchange device of claim 2, wherein:

the inlet of the first chamber is configured to be connected to a first stage regulator; and the outlet of the second chamber is configured to be connected to a second stage regulator.

6. The heat exchange device of claim 2, wherein at least one of the manifold and the heat sink is made of copper, copper alloy, or other material of high thermal conductivity.

7. The heat exchange device of claim 2, wherein the second chamber of the manifold comprises a plurality of outlets that are each configured to be connected to a second stage regulator.

8. A heat exchange device for use with underwater diving equipment including a pressurized gas source, comprising:

a manifold including a first chamber and a second chamber separated by a wall, each chamber including an inlet and an outlet for flow of gas into and out of each chamber; and a heat sink for heat exchange between the gas flowing in the heat sink and ambient water surrounding the heat sink, wherein the heat sink includes a passage for the gas to flow, wherein a first end of the passage is connected to the outlet of the first chamber, and wherein a second end of the passage is connected to the inlet of the second chamber, wherein the manifold and the heat sink are shaped and arranged such that during operation of the heat exchange device, at least a portion of the gas in the first chamber of the manifold is in direct contact with the wall and at least a portion of the gas in the second chamber is in direct contact with the wall.

9. The heat exchange device of claim 8, wherein the heat sink comprises coiled tubing.

10. The heat exchange device of claim 9, wherein:

the tubing comprises an internal diameter that is between 5 mm and 10 mm; and the tubing comprises an uncoiled length that is between 36 inches and 120 inches.

11. The heat exchange device of claim 8, wherein:

an inlet of the first chamber is configured to be connected to a first stage regulator; and an outlet of the second chamber is configured to be connected to a second stage regulator.

12. The heat exchange device of claim 8, wherein at least one of the manifold and the heat sink is made of copper, copper alloy, or other material of high thermal conductivity.

* * * * *